US009533503B2

(12) United States Patent
Netsu et al.

(10) Patent No.: US 9,533,503 B2
(45) Date of Patent: Jan. 3, 2017

(54) LIQUID EJECTION HEAD

(71) Applicant: CANON KABUSHIKI KAISHA, Tokyo (JP)

(72) Inventors: Hiroshi Netsu, Yokohama (JP); Toshifumi Yoshioka, Hiratsuka (JP); Masato Yajima, Utsunomiya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/836,837

(22) Filed: Aug. 26, 2015

(65) Prior Publication Data

US 2016/0059556 A1 Mar. 3, 2016

(30) Foreign Application Priority Data

Aug. 29, 2014 (JP) ..... 2014-175519

(51) Int. Cl.
*B41J 2/12* (2006.01)
*B41J 2/14* (2006.01)

(52) U.S. Cl.
CPC ... *B41J 2/14233* (2013.01); *B41J 2002/14491* (2013.01)

(58) Field of Classification Search
CPC ..... B41J 2/14201; B41J 2/14072; B41J 2/295; B41J 2/25; B41J 2/14233
USPC ..... 347/20, 40, 48, 50
See application file for complete search history.

(56) References Cited

U.S. PATENT DOCUMENTS

2012/0086759 A1* 4/2012 Takada ..... B41J 2/14233 347/71
2012/0206540 A1* 8/2012 Kato ..... B41J 2/161 347/50

FOREIGN PATENT DOCUMENTS

JP 2010214791 A * 9/2010
JP 2012-532772 A 12/2012

* cited by examiner

*Primary Examiner* — Julian Huffman
*Assistant Examiner* — Sharon A Polk
(74) *Attorney, Agent, or Firm* — Canon U.S.A. Inc., IP Division

(57) ABSTRACT

A liquid ejection head includes a plurality of piezoelectric transducers that are configured to generate energy for respectively ejecting liquid from a plurality of ejection ports and arranged in line so as to constitute a plurality of columns and a common electrode connected to the plurality of piezoelectric transducers. The common electrode is provided with a plurality of first connection areas to which the plurality of piezoelectric transducers are connected commonly in units of columns and a second connection area that connects the plurality of first connection areas to one another. This liquid ejection head further includes a reinforcing wiring laminated on the second connection area and a wiring substrate including a drive wiring that is connected to the reinforcing wiring at at least one connection point and electrically connected to the common electrode via the connection point.

5 Claims, 11 Drawing Sheets

LIQUID EJECTION HEAD

BACKGROUND OF THE INVENTION

Field of the Invention

The present invention relates to a liquid ejection head that ejects liquid by using a piezoelectric transducer.

Description of the Related Art

Up to now, a liquid ejection recording apparatus configured to record an image on a recording medium by ejecting liquid has been proposed as a recording apparatus. A liquid ejection head that ejects liquid is mounted on the liquid ejection recording apparatus. As a liquid ejection mechanism of the liquid ejection head, a mechanism has been proposed in which a piezoelectric transducer represented by piezoelectric zirconate titanate (PZT) is provided in a pressure chamber, and introduction and ejection of the liquid are performed by changing an inner volume of the pressure chamber. The pressure chamber communicates with both a liquid supply path through which the liquid is supplied and an ejection port from which the liquid is ejected. At the time of shrinkage of the pressure chamber, the liquid in the pressure chamber is ejected from the ejection port as a droplet, and at the time of expansion of the pressure chamber, the liquid is supplied from the liquid supply path to the pressure chamber.

In recent years, there has been a demand for recording to be performed with high image quality at high speed. To realize such recording, a large number of ejection ports are to be arranged at a high density, and a large number of drive wirings for driving piezoelectric transducers corresponding to the respective ejection ports are to be led. For this reason, since the number of connection points with external wirings (for example, flexible printed circuits (FPC)) for connecting the drive wirings to a drive circuit of the piezoelectric transducers is increased, the space between the wirings is reduced, and there is a concern that arranging the wirings becomes difficult. In view of the above, PCT Japanese Translation Patent Publication No. 2012-532772 proposes a technology for addressing the above-described problem. PCT Japanese Translation Patent Publication No. 2012-532772 discloses the technology with which the drive wirings of the piezoelectric transducers, the drive circuit of the piezoelectric transducers, and the paths for supplying ink to the pressure chambers are integrally formed on a wiring substrate, which is bonded to a liquid ejection substrate provided with the pressure chambers and the ejection ports. Accordingly technology, provision of external wirings is avoided.

According to the technology disclosed in PCT Japanese Translation Patent Publication No. 2012-532772, after the drive circuit of the piezoelectric transducers and flow paths of through holes are formed on a wiring substrate constituted by a silicon substrate, the wiring substrate is bonded to the liquid ejection substrate. However, carrying out a process of forming the through holes and the like on the single silicon substrate and a process of forming semiconductor elements constituting the drive circuit involves technical difficulty. In addition, a wiring substrate on which a dedicated-use drive circuit is formed in accordance with a configuration and a shape of the liquid ejection head is to be designed and manufactured.

In view of the above, a mode is conceivable in which the drive wirings of the piezoelectric transducers and the drive circuit of the piezoelectric transducers are formed on separate members, and the drive wirings and the drive circuit are connected to each other by external wirings. In the liquid ejection head in which a large number of piezoelectric transducers are used, in general, the respective piezoelectric transducers are sandwiched between individual electrodes and a common electrode. The individual electrodes are individually connected to the respective piezoelectric transducers. The common electrode is commonly connected to all the piezoelectric transducers. The individual electrodes and the common electrode are connected to the external wirings via the drive wirings.

As described above, in a case where the common electrode is set to be common to all the piezoelectric transducers, variations of distances from the common electrode to the respective piezoelectric transducers become large, and differences in voltage drops in accordance with the distances also become large. Thus, variations of drive signals applied to the respective piezoelectric transducers also become large. As a result, the magnitude of ejection energy generated by the respective piezoelectric transducers to cause the liquid to be ejected from the ejection ports fluctuates, and ejection performance, such as ejection speed or ejection amount, may fluctuate in some cases.

SUMMARY OF THE INVENTION

In view of the above, a liquid ejection head according to an aspect of the present invention includes a plurality of piezoelectric transducers that are configured to generate energy for respectively ejecting liquid from a plurality of ejection ports and arranged in line so as to constitute a plurality of columns, a common electrode connected to the plurality of piezoelectric transducers, a reinforcing wiring, and a wiring substrate, the common electrode including: a plurality of first connection areas to which the plurality of piezoelectric transducers are connected commonly in units of column and a second connection area that connects the plurality of first connection areas to one another, the reinforcing wiring being laminated on the second connection area, and the wiring substrate including a drive wiring that is connected to the reinforcing wiring at at least one connection point and electrically connected to the common electrode via the connection point.

According to the aspect of the present invention, the reinforcing wiring is laminated on the second connection area of the common electrode, and the drive wiring is electrically connected to the common electrode via this reinforcing wiring. For this reason, when the drive signals are respectively applied to the plurality of piezoelectric transducers from the drive wiring via the second connection area, a voltage drop of the drive signal caused by electric resistance of the second connection area is suppressed. Accordingly, variations of the ejection energy generated by the respective piezoelectric transducers to eject the liquid from the ejection ports are suppressed.

Further features of the present invention will become apparent from the following description of exemplary embodiments with reference to the attached drawings.

DESCRIPTION OF THE EMBODIMENTS

Figure 1A:
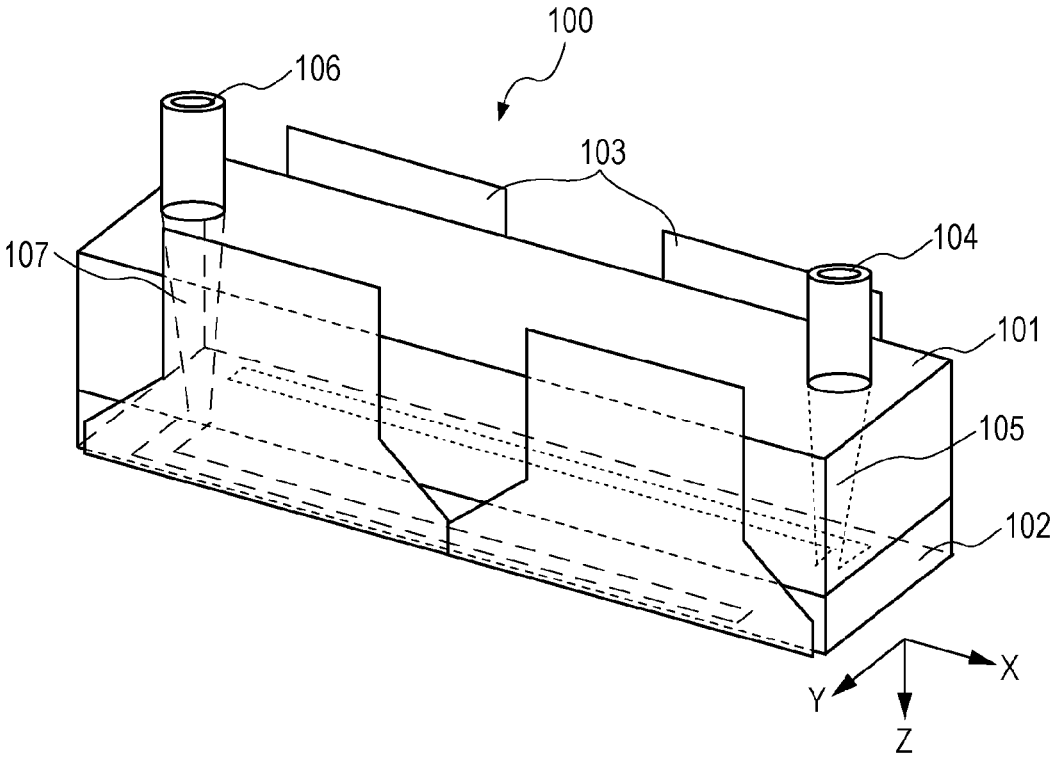
FIGS. 1A and 1B are a perspective view and a plan view of a liquid ejection head according to an exemplary embodiment of the present invention.
Figure 1B:
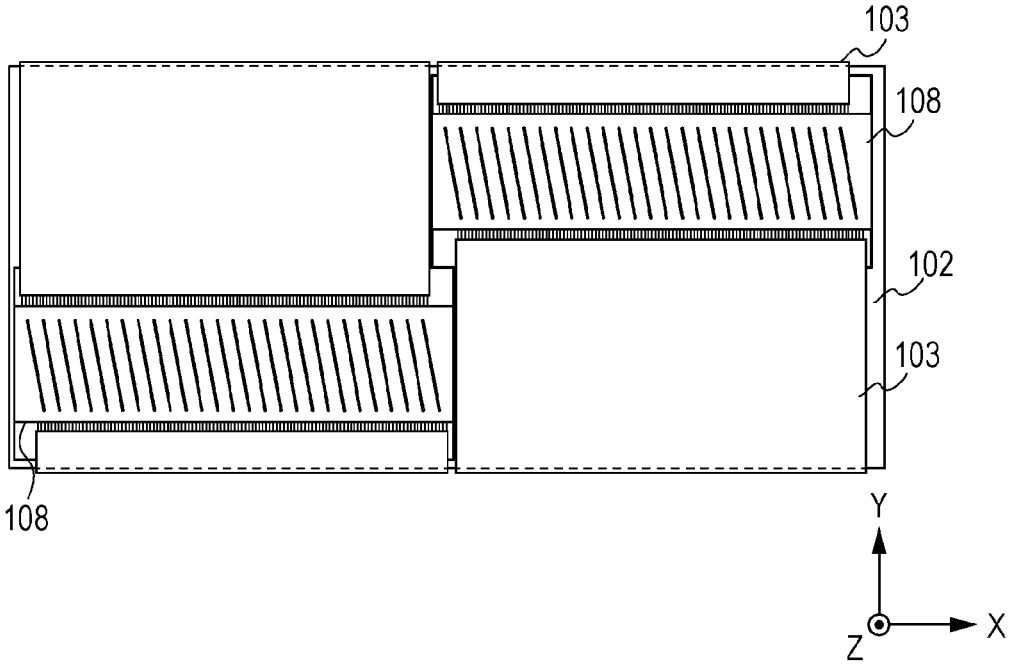

FIGS. 1A and 1B are a perspective view and a plan view of a liquid ejection head according to an exemplary embodiment of the present invention. FIG. 1A is a perspective view illustrating an overall configuration of a liquid ejection head 100 according to the present exemplary embodiment. FIG. 1B is a plan view of the liquid ejection head 100 illustrated in FIG. 1A as seen from an ejection surface side (−Z direction). To facilitate understanding of a configuration of the liquid ejection head 100, FIG. 1A illustrates a transparent flow path of liquid (ink according to the present exemplary embodiment).

As illustrated in FIG. 1A, the liquid ejection head 100 according to the present exemplary embodiment includes a manifold 101 and a chip plate 102. The manifold 101 is made mainly of a stainless steel material. A head chip 108 (see FIG. 1B) is mounted on the chip plate 102. In FIG. 1B, the two head chips 108 are mounted on the chip plate 102, but the number of the head chips 108 is not particularly restricted according to the exemplary embodiment of the present invention. The head chip 108 is linked to the manifold 101 via an inlet flow path 105 or an outlet flow path 107. The inlet flow path 105 is linked to a liquid supply part (not illustrated) via a joint part 104. The liquid supplied from this liquid supply part flows through the inlet flow path 105 into the head chip 108. Thereafter, the liquid that has passed through the head chip 108 is collected via the outlet flow path 107.

An external wiring 103 is connected to the head chip 108. According to the present exemplary embodiment, the external wiring 103 is constituted by FPC. The external wiring 103 includes a wiring for transmitting a drive signal transmitted from a drive circuit (not illustrated) to the head chip 108. It is noted that, according to the present exemplary embodiment, the above-described drive circuit is provided in a main body part of a liquid ejection recording apparatus to which the liquid ejection head 100 is attached.

Figure 2:
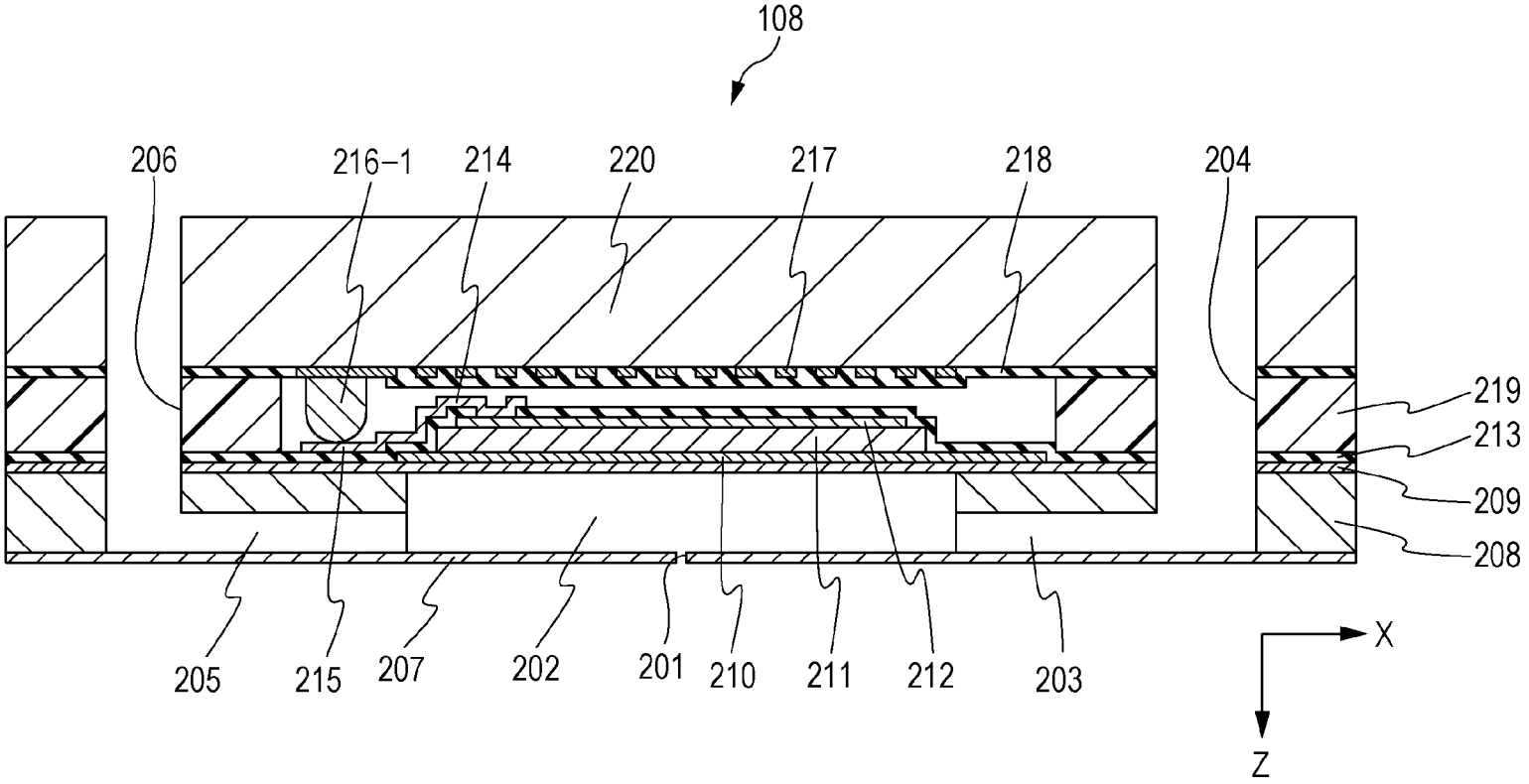
FIG. 2 is a cross sectional view of a part of a head chip as seen from a Y direction.
Figure 3:
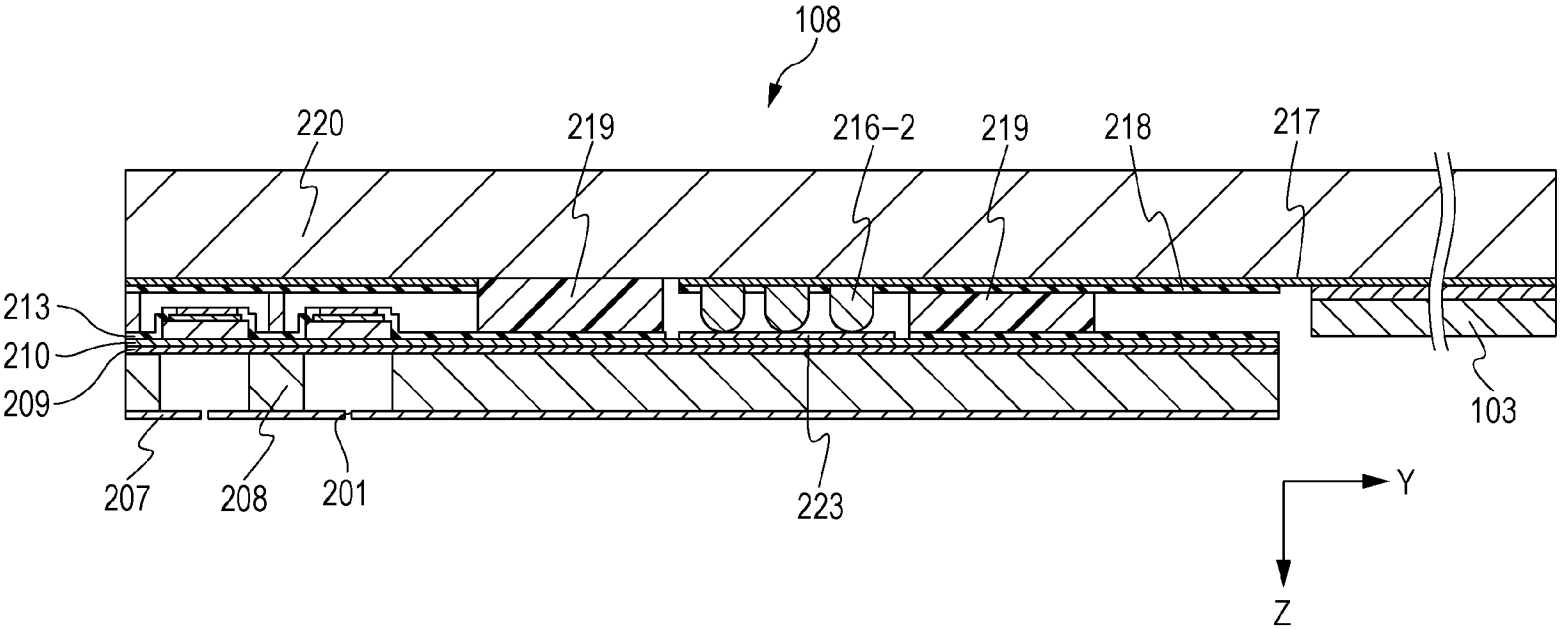
FIG. 3 is a cross sectional view of an area in the vicinity of a connection part of the head chip and an external wiring as seen from an X direction.

FIG. 2 is a cross sectional view of a part of the head chip 108 as seen from the Y direction. FIG. 3 is a cross sectional view of an area in the vicinity of a connection part of the head chip 108 and the external wiring 103 as seen from the X direction.

The head chip 108 includes an orifice plate 207, a flow path formation substrate 208, and a wiring substrate 220. A plurality of ejection ports 201 are formed on the orifice plate 207. A plurality of pressure chambers 202 that respectively communicate with the respective ejection ports 201 and store the liquid are formed on the flow path formation substrate 208. In addition, supply paths 203 through which the liquid is supplied to the respective pressure chambers 202 and collection paths 205 through which the liquid is collected from the respective pressure chambers 202 are also formed on the flow path formation substrate 208. The supply path 203 and the collection path 205 have larger inertia than that of the ejection port 201 such that a pressure generated in the pressure chamber 202 is directed toward the ejection port 201.

A vibrating plate 209 constituting a part of a wall section and the piezoelectric transducer 211 that is bonded to the vibrating plate 209 and generates a pressure for deforming the vibrating plate 209 are provided in each of the pressure chambers 202. A common electrode 210 is formed between the vibrating plate 209 and the piezoelectric transducer 211 that generates energy used for ejecting the liquid. An individual electrode 212 is formed on an upper part of the piezoelectric transducer 211. A protecting film 213 that provides insulation protection is formed on a surface of the common electrode 210 and a surface of the individual electrode 212. As illustrated in FIG. 2, the individual electrode 212 is electrically connected to a drive wiring 217 (another drive wiring) of the wiring substrate 220 by a bump 216-1. As illustrated in FIG. 3, the common electrode 210 is electrically connected to the drive wiring 217 by a bump 216-2. A gold bump can be used for the bumps 216-1 and 216-2, for example. The drive wiring 217 is connected to the external wiring 103 at each end section in the Y direction of the wiring substrate 220. A protecting film 218 that provides insulation protection is formed on a surface of the drive wiring 217.

The individual electrode 212 is led to a pad 215 by a lead wiring 214 and is connected to the bump 216-1 by the pad 215 (see FIG. 2). On the other hand, the common electrode 210 extends from lower parts of the piezoelectric transducers 211 provided to the respective pressure chambers 202 to a reinforcing wiring (common wiring) 223 provided at an end section in the Y direction of the flow path formation substrate 208 and is connected to the bump 216-2 by the reinforcing wiring 223.

The wiring substrate 220 is bonded to the flow path formation substrate 208 on which the plurality of pressure chambers 202 are two-dimensionally arranged and has a supporting function by maintaining rigidity of the flow path formation substrate 208. The wiring substrate 220 includes a supply communication hole 204 that communicates with the supply path 203 and a collection communication hole 206 that communicates with the collection path 205 (see FIG. 2). Accordingly, the wiring substrate 220 has a function of supplying the liquid to the pressure chamber 202 and also collecting the liquid from the pressure chamber 202. Furthermore, the wiring substrate 220 has a function of applying a drive signal to the piezoelectric transducer 211 via the drive wiring 217. The wiring substrate 220 is bonded to the flow path formation substrate 208 by a photosensitive resin layer 219. Penetration holes that respectively communicate with the supply communication hole 204 and the collection communication hole 206 are formed on the photosensitive resin layer 219.

The following circulatory flow is formed in the liquid ejection head 100. That is, the liquid is supplied from the inlet flow path 105 to the pressure chamber 202 via the supply communication hole 204 and the supply path 203, and thereafter, the liquid is collected from the outlet flow path 107 via the collection path 205 and the collection communication hole 206. In addition, in the liquid ejection head 100 according to the present exemplary embodiment, when the drive signal is applied from the drive circuit to the piezoelectric transducer 211 via the drive wiring 217 of the wiring substrate 220, since the piezoelectric transducer 211 generates the energy for deforming the vibrating plate 209, the volume of the pressure chamber 202 is reduced. Accordingly, pressure is generated in the pressure chamber 202, and the liquid can be ejected from the ejection port 201 by the generated pressure.

As illustrated in FIG. 3, the reinforcing wiring 223 is formed at the end section in the Y direction of the flow path formation substrate 208, and the bump 216-2 is bonded to the reinforcing wiring 223. The common electrode 210 is connected to the drive wiring 217 of the wiring substrate 220 by the bump 216-2. The drive wiring 217 is connected to the external wiring 103 on an outer side of an area overlapping the flow path formation substrate 208 in the wiring substrate 220. According to the present exemplary embodiment, an anisotropic conductive film (ACF) is used for pressure bonding between the drive wiring 217 and the external wiring 103. An opposite side of the external wiring 103 connected to the head chip 108 is connected to the drive circuit provided in the main body part of the liquid ejection recording apparatus. According to the present exemplary embodiment, the external wiring 103 is the FPC, but a chip on film (COF) to which an IC having an ejection nozzle selection function for the drive circuit is mounted may be used instead of the FPC. In this case, it is possible to significantly reduce the number of wirings between the COF and the drive circuit compared with the FPC.

Figure 4A:
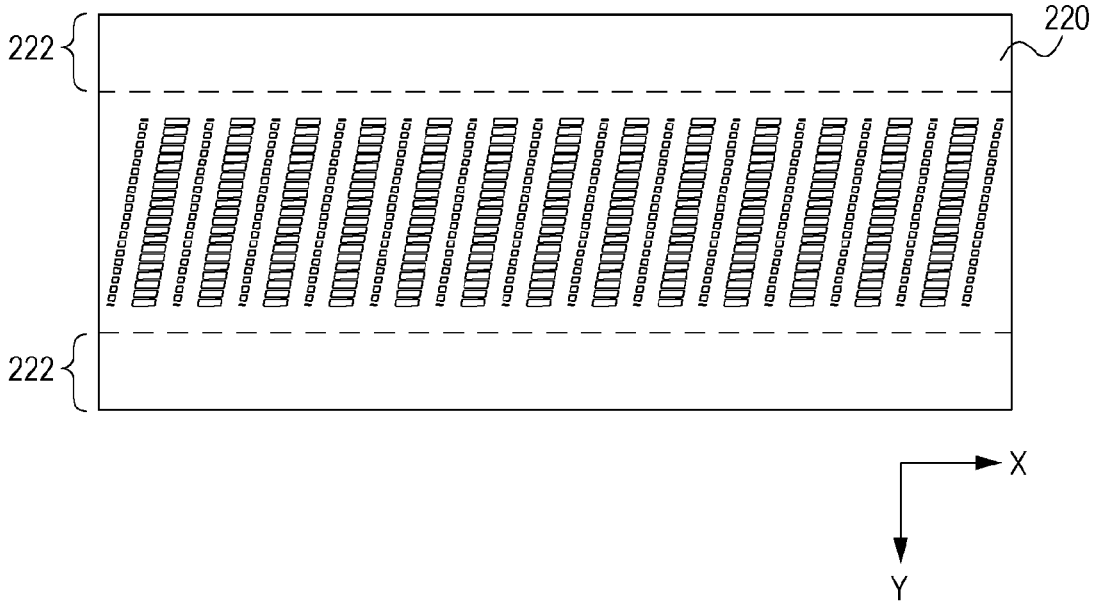
FIGS. 4A and 4B are plan views of a wiring substrate and a photosensitive resin layer.

FIG. 4A is a plan view of the wiring substrate 220. The wiring substrate 220 is provided with connection areas 222 connected to the external wiring 103 in each of the end sections in the Y direction, and therefore, a length in the Y direction is longer than that of the other members (the photosensitive resin layer 219, the flow path formation substrate 208, and the orifice plate 207). According to the present exemplary embodiment, the wiring substrate 220 is a silicon substrate. A penetration hole that constitutes the supply communication hole 204 and the collection communication hole 206 is formed on the wiring substrate 220. In addition, the drive wiring 217 is formed on a rear surface of the wiring substrate 220.

Figure 4B:
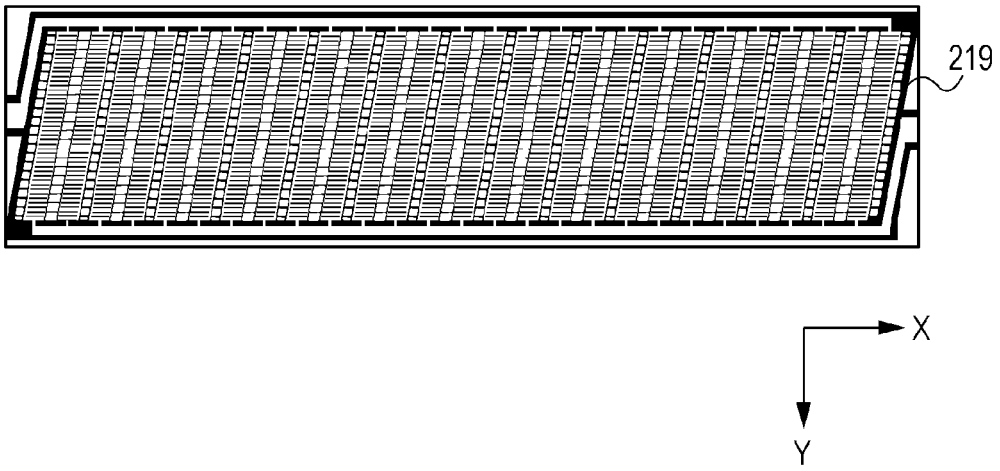

FIG. 4B is a plan view of the photosensitive resin layer 219 for bonding the wiring substrate 220 to the flow path formation substrate 208. For example, a photosensitive dry film such as DF470 (manufactured by Hitachi Chemical Co., Ltd.) can be applied as the photosensitive resin layer 219.

FIGS. 5A to 5D are plan views illustrating main layers constituting the flow path formation substrate 208.

Figure 5A:
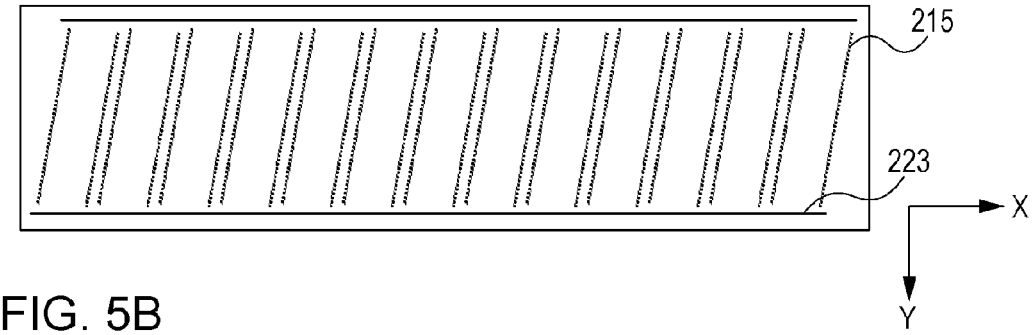
FIGS. 5A to 5D are plan views illustrating a plurality of layers constituting a flow path formation substrate.

FIG. 5A illustrates a formation layer of the pad 215 and the reinforcing wiring 223. According to the present exemplary embodiment, the pad 215 and the reinforcing wiring 223 are made of an AlSiCu metal having a thickness of approximately 1 μm. The pads 215 for leading the individual electrode 212 are formed in a line pointing toward each of the end sections in the Y direction from a central section of the flow path formation substrate 208. The reinforcing wirings 223 are formed in a straight line manner extending in the X direction toward each of the end sections in the Y direction of the flow path formation substrate 208.

Figure 5B:
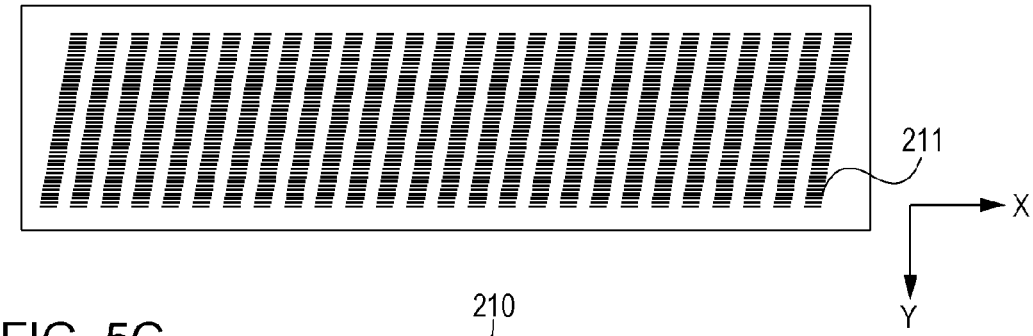

FIG. 5B illustrates a formation layer of the piezoelectric transducer 211. According to the present exemplary embodiment, the piezoelectric transducer 211 is formed to have a thickness of approximately 2 μm by a sol-gel method and is thereafter subjected to patterning into a plurality of columns corresponding to the pressure chambers 202.

Figure 5C:
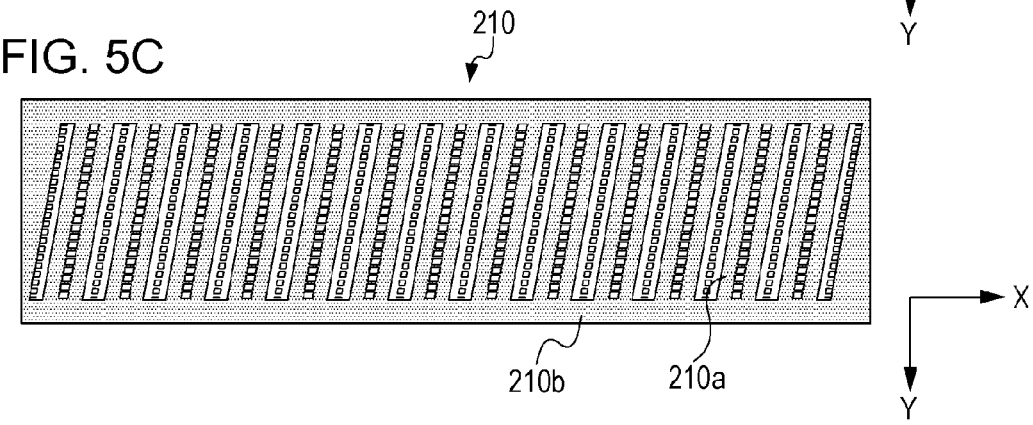

FIG. 5C illustrates a formation layer of the common electrode 210. According to the present exemplary embodiment, the common electrode 210 is made of platinum (Pt) having a thickness of 20 to 200 nm. The common electrode 210 includes a plurality of first connection areas (first common electrodes) 210*a* to which the plurality of piezoelectric transducers 211 are connected commonly in units of column and a second connection area (second common electrode) 210*b* that connects the first connection areas to each other. It is noted that the units of column may be one column or two columns. The reinforcing wiring 223 is laminated on the second connection area 210*b*.

Figure 5D:
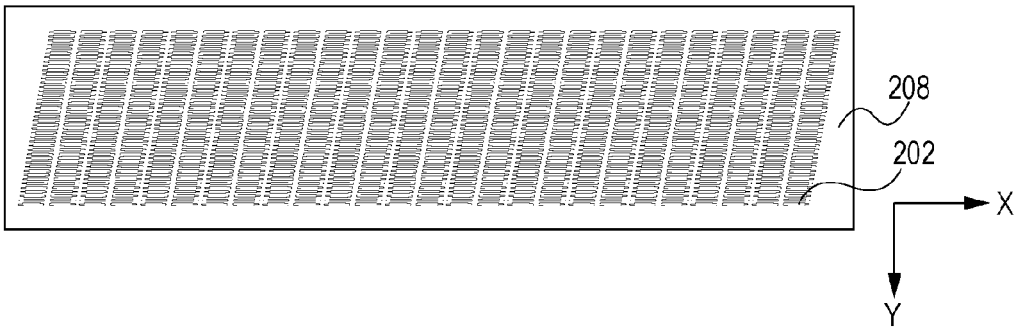

FIG. 5D illustrates a formation layer of the pressure chamber 202. According to the present exemplary embodiment, the pressure chamber 202 is formed by applying deep reactive ion etching (Deep-RIE) to the flow path formation substrate 208 constituted by the silicon substrate. It is noted that the supply path 203 and the collection path 205 are also formed by the same method as the pressure chamber 202.

Figure 6:
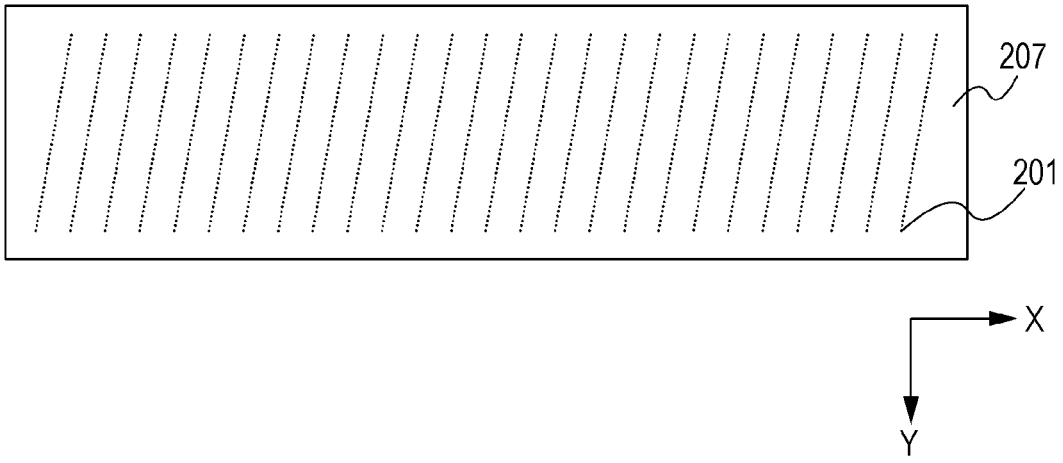
FIG. 6 is a plan view of an orifice plate.

FIG. 6 is a plan view of the orifice plate 207. The plurality of ejection ports 201 are formed on the orifice plate 207. A water-repellent finish is applied to the ejection surface of the orifice plate 207. According to the present exemplary embodiment, the ejection ports 201 aligned in the Y direction are arranged by being shifted from the adjacent ejection port 201 in the X direction by an amount corresponding to a recording resolution. The liquid ejection head 100 ejects the liquid from the respective ejection ports 201 onto the recording medium that relatively moves in the Y direction with respect to the orifice plate 207. Accordingly, an image is formed on the recording medium. According to the present exemplary embodiment, to realize a recording resolution of 1200 dots per inch (dpi), the ejection ports 201 are arranged by being shifted in the X direction by 21.17 μm. Furthermore, the 42 pressure chambers 202 constitute one ejection port column aligned in the Y direction of the flow path formation substrate 208. It is however noted that the pressure chambers 202 located at each of the end sections in this column are dummy chambers. In addition, according to the present exemplary embodiment, the ejection ports in 26 columns are aligned in the X direction. Accordingly, it is possible to form an image having a width of approximately 0.86 inches by using the ejection ports 201, which total 1040. It is noted that, according to the present exemplary embodiment, the flow path formation substrate 208 has a length of approximately 23.5 mm in the X direction and a length of approximately 6.2 mm in the Y direction.

Figure 7A:
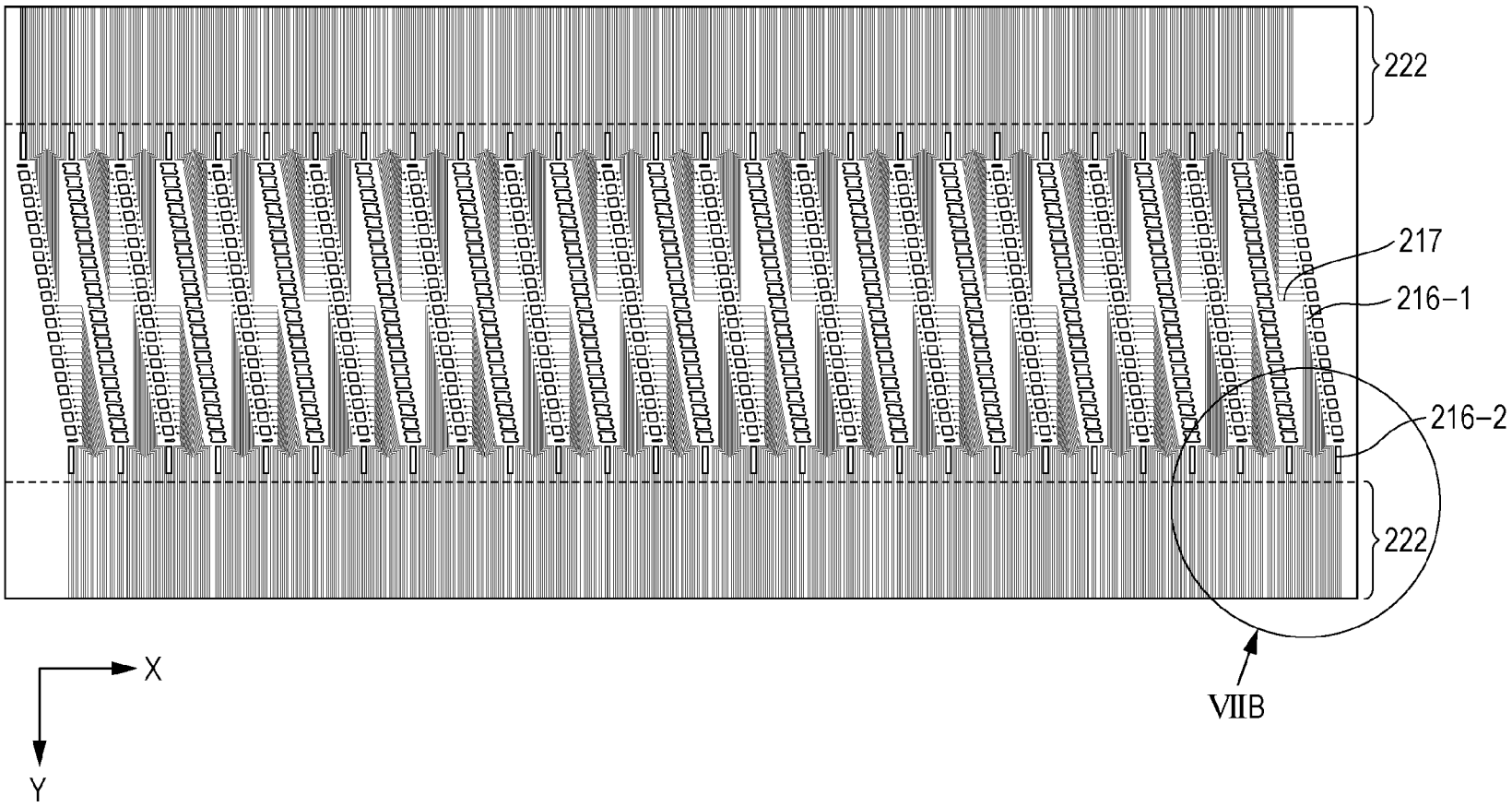
FIGS. 7A and 7B are plan views illustrating wiring layouts of the wiring substrate.
Figure 7B:
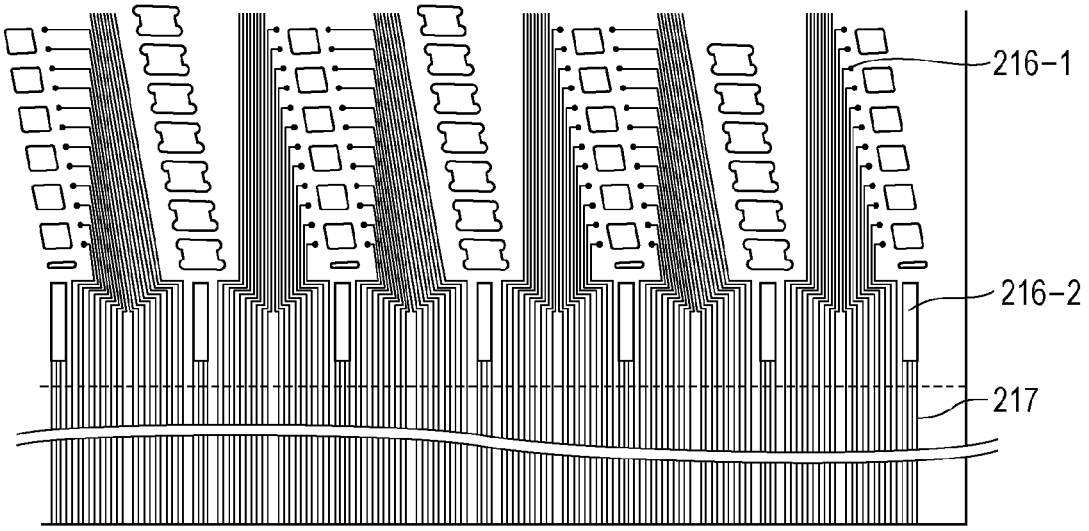

FIGS. 7A and 7B are plan views illustrating wiring layouts of the wiring substrate 220. FIG. 7A illustrates the wiring substrate 220 as seen from the formation surface of the drive wiring 217 and the bumps 216-1 and 216-2 corresponding to an illustration of the wiring substrate 220 as seen from an opposite surface (rear surface) with respect to FIG. 4A. FIG. 7B is an enlarged view of an area VIIB surrounded by a circle illustrated in FIG. 7A.

As illustrated in FIG. 7A, arrangement parts of the bumps 216-1 are provided from the central section of the wiring substrate 220 toward each of the end sections in the Y direction, and arrangement parts of the bumps 216-2 are provided in each of the end sections in the Y direction of the wiring substrate 220. The drive wiring 217 connected to the bump 216-1 or the bump 216-2 is connected to the external wiring 103 in the connection area 222 of the wiring substrate 220. According to the present exemplary embodiment, the ejection ports 201 are arranged so as to correspond to the recording resolution of 1200 dpi. For this reason, by leading each half of the drive wiring 217 to the two connection areas 222 to lead the individual electrodes 212 in one column, the drive wiring 217 is connected to the external wiring 103 in one of the connection areas 222 so as to correspond to a recording resolution of 600 dpi. In addition, according to the present exemplary embodiment, the four drive wirings 217 connected to the common electrode 210 are provided with respect to the 20 drive wirings 217 connected to the individual electrodes 212 on one-half of the column. The drive wirings 217 each having a line width of approximately 17.6 μm are arranged in the connection area 222 at a pitch of 17.6 μm. A layout illustrated in FIG. 7A is obtained when the drive wiring 217 is led around at a shortest distance that provides the drive wiring 217 with the shortest distance while avoiding bends as much as possible.

In FIG. 7B, the single bump 216-2 is arranged in one column with respect to the bumps 216-1. As a method of widening the pitch of the drive wiring 217 in the connection area 222, for example, a method of arranging the single bump 216-2 in two columns with respect to the bumps 216-1 is conceivable. In this case, it is possible to arrange the drive wirings 217 each having a line width of approximately 19.2 μm at a pitch of 19.2 μm in the connection area 222. However, if the number of connection areas between the common electrode 210 and the drive wirings 217 is reduced, a voltage drop of the drive signal caused by electric resistance of the common electrode 210 in the column where the reduction takes place is increased. As a result, there is a concern that a difference in ejection performance, such as ejection speed or ejection amount of the liquid, may occur. Since the common electrode 210 is formed between the vibrating plate 209 and the piezoelectric transducer 211 and functions as a part of the vibrating plate 209, it is difficult to decrease the electric resistance by increasing the thickness of the common electrode 210. For this reason, in the liquid ejection head 100 according to the present exemplary embodiment, the reinforcing wiring 223 is arranged on the second connection area 210*b* of the common electrode 210 to suppress the voltage drop in the common electrode 210. Accordingly, the voltage drop of the drive signal in the second connection area 210*b* is suppressed.

According to the present exemplary embodiment, the reinforcing wiring 223 is made of an AlSiCu metal having a thickness of approximately 1 μm, which is the same as that of the pad 215. For this reason, the reinforcing wiring 223 has higher conductivity than the common electrode 210 made of platinum (Pt). As a result, the voltage drop of the drive signal is further suppressed, and it is possible to improve the effect of avoiding variations in ejection performance.

Figure 8:
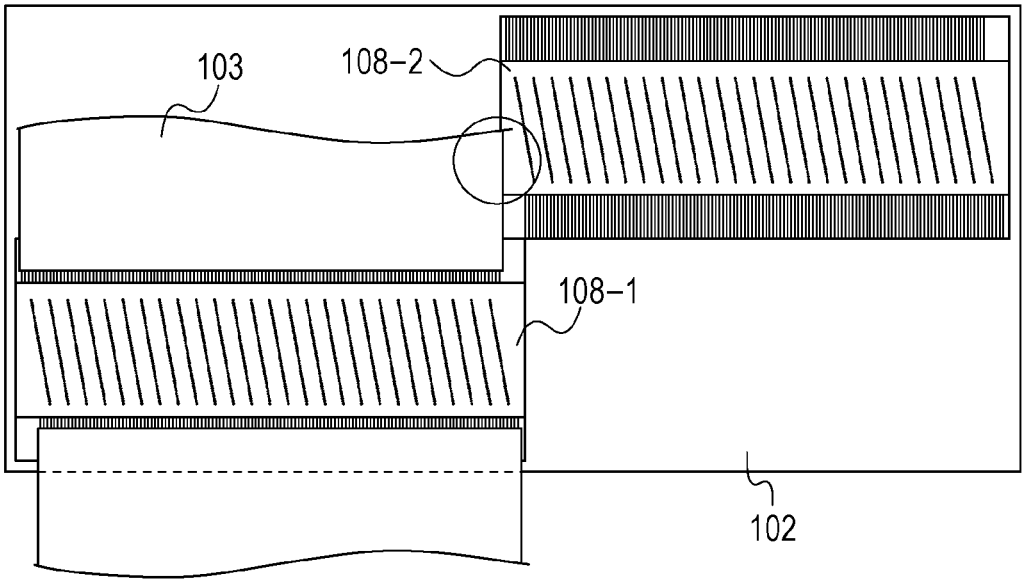
FIG. 8 is a plan view illustrating a state in which two head chips are mounted on a chip plate.

FIG. 8 is a plan view illustrating a state in which the two head chips 108 are mounted on the chip plate 102. In FIG. 8, in order that a gap is not generated in an image formed on the recording medium, two head chips are arranged such that an ejection port at a left end of a head chip 108-2 is arranged at a position on a right side 21.17 μm from an ejection port at a right end of a head chip 108-1. In this case, the external wiring 103 may be disposed on the head chip 108-2 in an overlapped part of the head chip 108-1 and the head chip 108-2 (a part surrounded by a circle in FIG. 8). In view of the above, it is conceivable to reduce the width of the external wiring 103. To reduce the width of the external wiring 103, the pitch of the drive wirings 217 in the connection area 222 of the wiring substrate 220 is to be decreased. However, even when attempts are made to uniformly decrease the pitch of the drive wirings 217 in the connection area 222, the position of the bump 216-1 connected to the individual electrode 212 should not be changed. For this reason, a large number of the drive wirings 217 need to lead obliquely from the bump 216-1 to the connection area 222, and the area of the wiring substrate 220 is increased.

Figure 9A:
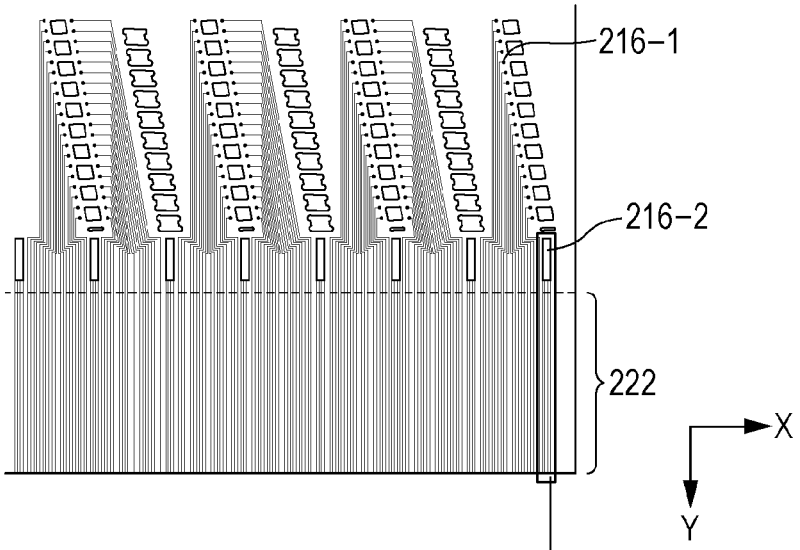
FIGS. 9A to 9C are plan views illustrating wiring layouts of the wiring substrate.
Figure 9B:
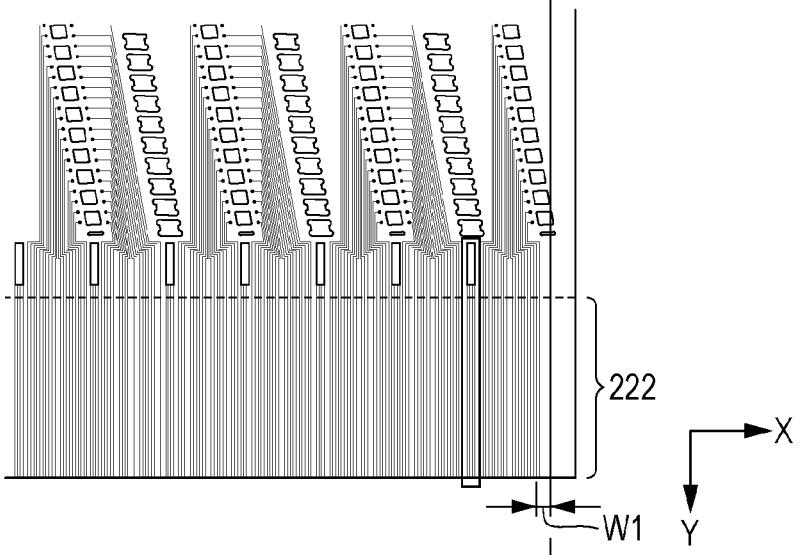
Figure 9C:
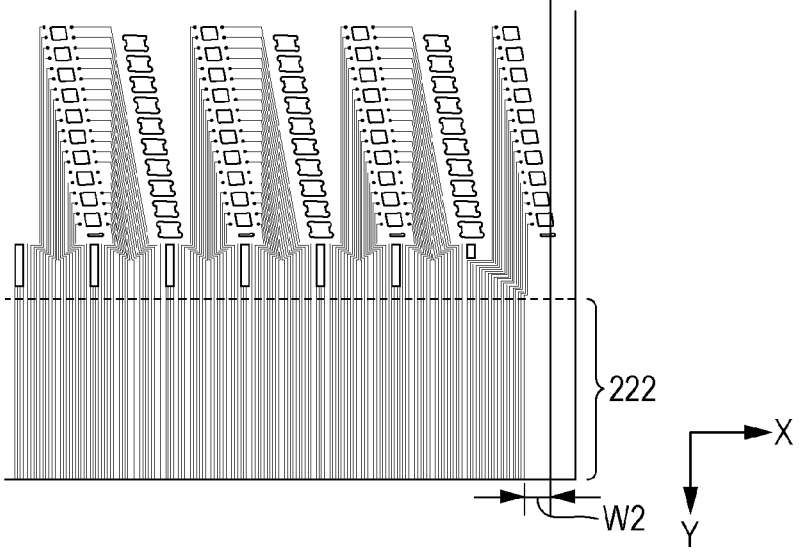

A method of addressing the above-described problem will be described by using FIGS. 9A to 9C. FIGS. 9A to 9C are plan views illustrating wiring layouts of the wiring substrate 220. Hereinafter, a method of reducing the width of the external wiring 103 by reducing the number of the drive wirings 217 arranged in the connection area 222 of the wiring substrate 220 will be described.

FIG. 9A illustrates the wiring substrate 220 in which the single bump 216-2 is arranged in one column with respect to the bumps 216-1. FIG. 9B illustrates a state in which a part surrounded by a rectangular illustrated in FIG. 9A is deleted. FIG. 9B illustrates a state in which the bumps 216-2 arranged in each of farthest end sections in the X direction of the wiring substrate 220 illustrated in FIG. 9A and the four drive wirings 217 connected to connected to the bumps 216-2 are deleted. According to the wiring substrate illustrated in FIG. 9B, the width of the formation area of the drive wiring 217 in the connection area 222 is narrower than the wiring substrate illustrated in FIG. 9A by W1. For this reason, it is possible to reduce the width of the external wiring 103 by this W1.

FIG. 9C illustrates the wiring substrate 220 in which a part surrounded by a rectangular illustrated in FIG. 9B is deleted. According to the wiring substrate 220 illustrated in FIG. 9C, the width of the formation area of the drive wiring 217 becomes narrower than the wiring substrate illustrated in FIG. 9A by W2 (>W1). For this reason, it is possible to further reduce the width of the external wiring 103. When the number of the drive wirings 217 connected to the common electrode 210 only at the end sections of the wiring substrate 220 is reduced in the above-described manner, since the area used for setting the drive wiring 217 to be oblique can be suppressed to the minimum, it is possible to suppress the increase in the size of the wiring substrate 220.

Figure 10:
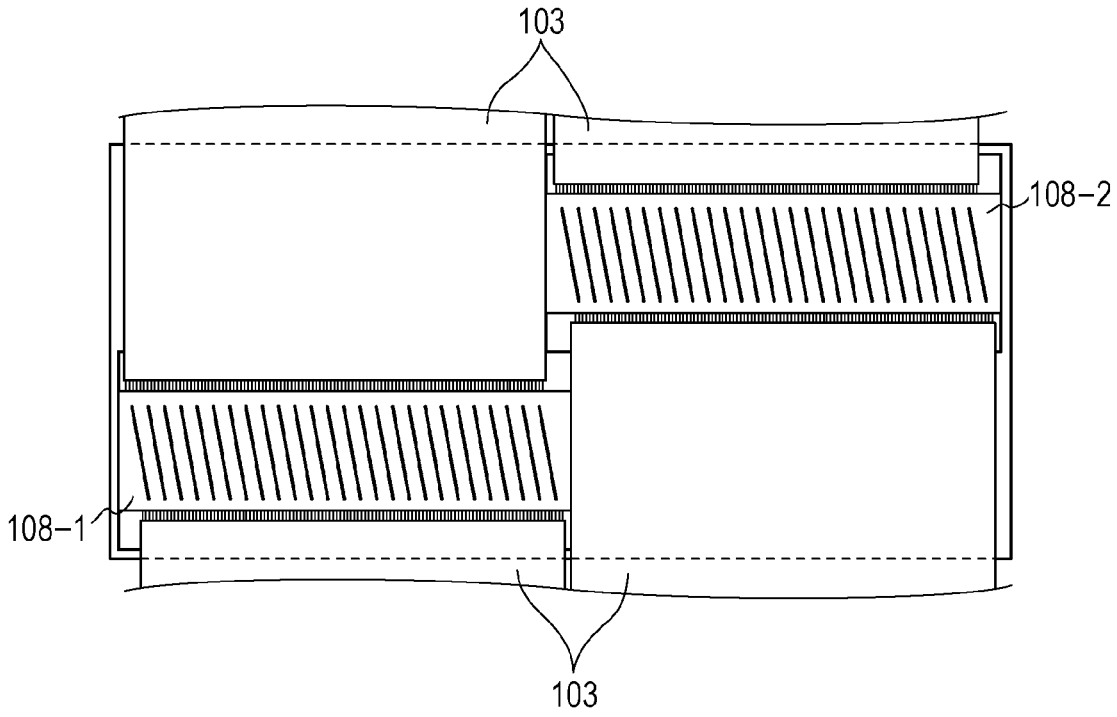
FIG. 10 is a plan view illustrating a state in which the external wiring is connected to the head chip.

FIG. 10 is a plan view illustrating a state in which the external wiring 103 is connected to the head chips 108-1 and 108-2 including the wiring substrate 220 illustrated in FIG. 9C. FIG. 10 illustrates a state in which the bumps 216-2 respectively arranged in the four corners of the wiring substrate 220 are deleted. In other words, this state corresponds to a state in which a density of the plurality of bumps 216-2 aligned in line in the X direction at the end section of the wiring substrate 220 (the number of bumps per unit area) is set to be lower than a density in the central section of the wiring substrate 220.

According to the wiring substrate 220 illustrated in FIG. 9C, the width of the formation area of the drive wiring 217 in the connection area 222 is reduced. Accordingly, as illustrated in FIG. 10, it is possible to connect the external wiring 103 to the two head chips 108-1 and 108-2 without being disposed on the orifice plate 207. When the number of connection points of the common electrode 210 and the drive wiring 217 is decreased, the voltage drop of the drive signal caused by the electric resistance of the common electrode 210 is increased, and there is a concern that the ejection speed may be decreased, or the ejection amount may be decreased. However, by extending the reinforcing wiring 223 described above to an area facing the bumps 216-2 arranged in the four corners of the wiring substrate 220 of the flow path formation substrate 208, it is possible to suppress the variations in the ejection performance caused by the voltage drop of the drive signal.

It is noted that, according to the above-described respective exemplary embodiments, the example in which the piezoelectric transducer is applied as an energy generating element that generates the energy used for ejecting the liquid has been illustrated, but the present invention is not limited to this. For example, a liquid ejection head provided with a heating element that generates air bubble in the liquid by thermal energy ejects the liquid can also be applied as the energy generating element.

As described above, according to the exemplary embodiments of the present invention, the variations in the ejection energy generated by the respective piezoelectric transducers are suppressed, and it is possible to suppress the variations in the ejection performance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-175519, filed Aug. 29, 2014, which is hereby incorporated by reference herein in its entirety.

What is claimed is:

1. A liquid ejection head comprising:

a plurality of element columns in which elements configured to generate energy used for ejecting liquid are aligned in a first direction, the element columns being arranged side-by-side in a second direction intersecting with the first direction;

a plurality of first common electrodes that are commonly connected to each of the plurality of element columns and are also arranged along each of the plurality of element columns;

a second common electrode that is commonly connected to the plurality of first common electrodes and extends in the second direction; and a common wiring that is connected to the second common electrode and extends in the second direction, wherein the first common electrodes and the second common electrode are formed on the same layer, and wherein the second common electrode and the common wiring are formed on different layers.

2. The liquid ejection head according to claim 1, wherein the second common electrode is connected to the common wiring by a bump.

3. The liquid ejection head according to claim 1, wherein the element includes a piezoelectric transducer.

4. The liquid ejection head according to claim 3, further comprising:

a pressure chamber that communicates with an ejection port from which the liquid is ejected; and a vibrating plate arranged to be adjacent to the pressure chamber, wherein the first common electrode is arranged between the piezoelectric transducer and the vibrating plate.

5. The liquid ejection head according to claim 1, wherein the second common electrode is arranged at one end side and the other end side of the element column.

* * * * *